US005132053A

United States Patent [19]

Crossin

[11] Patent Number: 5,132,053

[45] Date of Patent: Jul. 21, 1992

[54] CONCENTRATED SINGLE-PHASE BUILT LIQUID DETERGENT COMPOSITION AND LAUNDERING METHOD

[75] Inventor: Michael C. Crossin, Charlotte, N.C.

[73] Assignee: Colgate-Palmolive Company, Piscataway, N.J.

[21] Appl. No.: 656,126

[22] Filed: Feb. 14, 1991

Related U.S. Application Data

[63] Continuation-in-part of Ser. No. 511,825, Apr. 16, 1990, abandoned, which is a continuation of Ser. No. 304,876, Feb. 1, 1989, abandoned, which is a continuation of Ser. No. 228,791, Jul. 25, 1988, abandoned, which is a continuation of Ser. No. 881,587, Jul. 2, 1986, abandoned, which is a continuation of Ser. No. 682,971, Dec. 18, 1984, abandoned.

[51] Int. Cl.[5] ..... C11D 1/68; C11D 1/90

[52] U.S. Cl. ..... 252/546; 252/DIG. 1; 252/DIG. 7; 252/DIG. 14; 252/174.19; 252/546

[58] Field of Search ..... 252/DIG. 7, DIG. 14, 252/546, DIG. 1, 174.19

[56] References Cited

U.S. PATENT DOCUMENTS

| | | | |
|---|---|---|---|
| 2,877,178 | 3/1959 | Bergman et al. | 252/DIG. 7 |
| 2,953,526 | 9/1960 | Bergman et al. | 252/DIG. 7 |
| 3,235,505 | 2/1966 | Turell | 252/135 |
| 3,351,557 | 11/1967 | Almstead et al. | 252/546 |
| 3,579,453 | 5/1971 | Dupre et al. | 252/174.19 |
| 3,717,630 | 2/1973 | Booth | 252/301.24 |
| 3,876,563 | 4/1975 | Collins | 252/545 |
| 3,912,662 | 10/1975 | Martinson et al. | 252/527 |
| 3,958,928 | 5/1976 | Lala | 8/25 |
| 4,000,092 | 12/1976 | Wentler | 252/526 |
| 4,122,043 | 10/1978 | Kersnar et al. | 252/527 |
| 4,247,424 | 1/1987 | Kuzel et al. | 252/528 |
| 4,261,869 | 4/1981 | Bishop et al. | 252/542 |
| 4,277,378 | 7/1981 | Tsujii et al. | 252/546 |
| 4,284,532 | 8/1981 | Leikhim et al. | 252/528 |
| 4,391,726 | 7/1983 | Koster | 252/99 |
| 4,486,338 | 12/1984 | Outani et al. | 252/545 |
| 4,564,463 | 1/1986 | Secemski et al. | 252/174.17 |
| 4,582,636 | 4/1986 | Crossin | 252/546 |
| 4,595,526 | 6/1986 | Lai | 252/545 |
| 4,879,051 | 11/1989 | Lo et al. | 252/8.75 |

OTHER PUBLICATIONS

"Ampholytic Detergents", D. L. Anderson, *American Perfumer & Aromatic Documentary Edition* #1, Feb. 17, 1960.

*Primary Examiner*—Paul Lieberman
*Assistant Examiner*—Kery A. Fries
*Attorney, Agent, or Firm*—Bernard Lieberman; Murray M. Grill; Robert C. Sullivan

[57] ABSTRACT

A concentration aqueous single-phasse built liquid detergent composition is provided comprising:

(a) from about 15 to 18%, by weight of a water-soluble non-phosphate detergent builder salt;

(b) from about 15 to 23%, by weight, of a surface active nonionic detergent compound which is the condensation product of 5 to 9 moles of ethylene oxide with one mole of an aliphatic alcohol containing 12 to 15 carbon atoms;

(c) from about 1 to 6%, by weight of at least oen amphoteric detergent compound selected from among a group of described betaine detergent compounds;

(d) from about 5 to 8%, by weight, of a solubilizer selected from the group consisting of alkali metal salts of (i) nonyl succinic anhydride and (ii) nonyl maleic anhydride; and (e) from bout 45 to 60%, by weight, water, the liquid detergent composition being free of an amine oxide surfactant and capable of providing effective detergency at a product concentration equivalent to about ¼ cup under U.S. washing conditions.

21 Claims, No Drawings

CONCENTRATED SINGLE-PHASE BUILT LIQUID DETERGENT COMPOSITION AND LAUNDERING METHOD

This application is a continuation-in-part of copending Ser. No. 07/511,825 filed Apr. 16, 1990, the disclosure of which is incorporated herein by reference, which is a continuation of Ser. No. 07/304,876 filed Feb. 1, 1989, which is a continuation of Ser. No. 07/228,791 filed Jul. 25, 1988, which, in turn, is a continuation of Ser. No. 881,587 filed Jul. 2, 1986, which is a continuation of Ser. No. 682,971 filed Dec. 18, 1984, all now abandoned.

BACKGROUND OF THE INVENTION

This invention relates to concentrated aqueous, built liquid detergent compositions suitable for laundry or pre-soak formulations. More particularly, it relates to aqueous build liquid detergent compositions which are highly concentrated in surfactant and builder and are provided as homogeneous, clear single-phase liquid solutions.

The formulation of concentrated build aqueous liquid detergent compositions has been a commercial objective in the detergent art in recent years. It is generally required that such compositions provide good detergency at low product concentration in the bath, contain water as the principal solvent and are in the form of homogeneous single-phase solutions which provide long-term shelf life without undergoing phase separation. Conventional liquid detergent compositions containing a detergency builder are generally not highly concentrated. That is, they are formulated as relatively dilute aqueous solutions so as to solubilize the builder and surfactant in the liquid composition. To provide the desired detergency, relatively high concentrations of such product are needed in the bath.

The term "concentrated" as used herein refers to liquid detergent compositions which can provide effective detergency at a product concentration equivalent to about "¼ cup" under U.S. washing conditions, namely about 60 ml of detergent composition per standard wash load (about 17 U.S. gallons for a top loading washing machine), which corresponds to a concentration of about 0.1% of liquid detergent composition in the wash bath. To achieve a commercially acceptable level of detergency at such low product concentration, it is necessary that a high proportion of the detergent composition be comprised of active ingredients, notably, surfactant and builder. Thus, the term "concentrated" liquid detergent as used herein, is defined as a detergent composition which contains no more than about 65%, by weight, water.

As a practical matter, it is important that water is used as the principal, if not the sole, solvent in such concentrated liquid detergent composition, avoiding the use of costly solvents such as glycols. Accordingly, the liquid detergent compositions described herein contain at a minimum about 35% water, by weight of the liquid composition, a water content of about 45% to 60% being ordinarily preferred.

Build liquid detergent compositions are known in the art. However, because of the limited solubility of builder and surfactant in water, such detergent compositions are generally prepared as relatively dilute aqueous compositions containing for the most part in excess of 65%, and often as high as 93%, by weight, water.

Frequently, an alkylene glycol co-solvent is used to enhance the solubility of the built detergent composition. In those aqueous compositions which contain less than 65% water, the proportion of builder is generally kept low, i.e. no greater than about 10%, by weight, so as to enhance the solubility of the built detergent in water. To provide acceptable detergency when used under standard U.S. washing conditions, such known liquid compositions are conventionally used at product concentrations substantially above the "¼ cup" concentration (about 0.1%, by weight) at which the liquid detergent compositions of the present invention are effective. Moreover, the conventional detergent compositions are generally in the form of emulsions or suspensions rather than forming clear homogeneous solutions which are stable against phase separation.

The detergent compositions described in U.S. Pat. No. 3,912,662 to Martinsson et al, U.S. Pat. No. 4,021,377 to Borohert et al and U.S. Pat. No. 4,284,532 to Leikhim et al are illustrative of the prior art. The Martinsson et al patent discloses an aqueous detergent composition containing nonionic and betaine detergents and a polyphosphate builder. In example 1, a composition is described containing 66% water and 12% alkylene glycol as the solvent. The Borchert et al patent describes a phosphatefree liquid detergent composition containing citrate builder and surfactant in a water-glycol solvent. The amount of water in each of the seven compositions disclosed in Table 1 of the patent is less than 26%, by weight, the major portion of the solvent being an alkylene glycol. U.S. Pat. No. 4,284,532 to Leikhim et al describes a built liquid detergent composition containing from 40 to 65% water in a preferred mode and lists as essential ingredients an ethoxylated nonionic surfactant in combination with an amine oxide surfactant. Consequently, the ability to provide an economical liquid detergent composition which is free of amine oxide surfactants and the attendant health hazard which is often associated with this class of surfactants, and which utilizes water as the principal solvent yet is in the form of a concentrated clear single-phase solution remains as a problem yet to be overcome in formulating a commercially acceptable built concentrated liquid detergent composition.

SUMMARY OF THE INVENTION

The prevent invention provides a concentrated aqueous single-phase homogeneous built liquid detergent composition comprising:

(a) from about 15 to 18%, by weight, of a water-soluble non-phosphate detergent builder salt;

(b) from about 15 to 23%, by weight, of a surface active nonionic detergent compound which is the condensation product of 5 to 9 moles of ethylene oxide with one mole of an aliphatic alcohol containing 12 to 15 carbon atoms;

(c) from about 1 to 6%, by weight, of at least one amphoteric detergent compound selected from the group consisting of cocobetaine and cocoamido betaine;

(d) from about 5 to 8%, by weight, of a solubilizer selected from the group consisting of alkali metal salts of (i) nonyl succinic anhydride and (ii) nonyl maleic anhydride; and (e) from about 45 to 60%, by height, water, said liquid detergent composition being free of an amine oxide surfactant and providing effective detergency at a product concentration equivalent to about ½ cup under U.S. washing conditions.

In accordance with the process of the invention, laundering of stained and/or soiled materials is affected by contacting such materials with an aqueous solution of the above-defined liquid detergent composition.

Unlike the built liquid detergent compositions known in the art, the compositions of the present invention contain a high concentration of builder and surfactant yet are characteristically clear, single-phase homogeneous solutions which are physically stable over prolonged period of storage and over a wide range of temperature. The particular combinations of nonionic and betaine detergents with non-phosphate builder salt and solubilizer in accordance with the invention unexpectedly form clear single-phase aqueous solutions, highly concentrated in both surfactant and builder. From a commercial standpoint, the present compositions are particularly advantageous insofar as they are phosphate-free in conformity with governmental regulations in many areas which prohibit the use of phosphate-containing detergent; they are relatively economical to formulate in that they utilize water as the principal solvent and avoid the use of costly co-solvents such as alkylene glycols in other than minor amounts; they provide effective detergency at low product concentrations in the wash bath, notably at a so-called ¼ cup concentration, a desirably low concentration under U.S. washing conditions; and they are homogeneous solutions, avoiding problems of non-uniformity and phase separation associated with the storage and use of emulsions and dispersions.

The nonionic detergent compound in the described liquid detergent compositions may constitute from about 15 to 23%, and preferably from 17 to 19%, by weight, of the detergent composition, and the amphoteric detergent compound will generally vary from about 1 to 6%, preferably from 2 to 4%, by weight, of such compositions. The relative amounts of each of the aforementioned detergents is generally determined by the amount of builder salt employed. The higher the builder concentrations within the range of 15 to 18%, the lower the maximum concentration of nonionic detergent which may be employed in the composition and still form a stable single-phase solution. Conversely, at higher concentrations of builder salt, the concentration of amphoteric detergent and solubilizer is preferably increased within the ranges of concentration set forth above so as to solubilize the mixture and form a clear single-phase solution having the requisite detergency. Thus, for example, at a builder concentration of about 17% above, the preferred concentration of nonionic surfactant is from about 16 to 18%, the amphoteric detergent is from about 2 to 4%, and most desirably at least 3%, and the concentration of solubilizer is about 7 to 8%, all percentages being by weight of the total composition.

DETAILED DESCRIPTION OF THE INVENTION

The synthetic nonionic detergent employed in the practice of the invention is specific to those compounds which are the condensation product of 5 to 9 moles of ethylene oxide with an aliphatic alcohol containing 12 to 15 carbon atoms. The aliphatic alcohol is preferably a straight chain alcohol, and most preferably is a fatty alcohol or mixture thereof containing an average of 12 to 13 carbon atoms per mole. The number of ethylene oxide groups per mole of alcohol preferably averages about 6.5 or 7, Neodol ® 23-6.5 and Neodol ® 25-7 are particularly preferred for use herein, both of such products being made by Shell Chemical Company, Inc.

The amphoteric detergent compounds most useful in the compositions of the invention are the betaine and alkyl amido betaine detergent compounds having the following structures:

(i) betaine

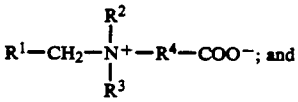

(ii) alkyl amido betaine

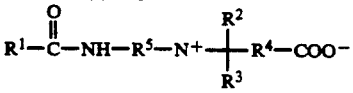

wherein in each of the above structures $R^1$ represents an alkyl chain or a mixture of alkyls containing 9 to 13 carbon atoms; $R^2$ and $R^3$ are independently methyl or ethyl; and $R^4$ and $R^5$ are independently methylene, ethylene or propylene radicals.

When $R^1$ is a mixture of alkyls of varying chain lengths, it is preferred that such mixture be comprised predominantly of alkyl having 9 to 13 carbon atoms, although it is sufficient, albeit less preferred, if only the predominant alkyl in the mixture contains 9 to 13 carbon atoms and the remaining alkyl chains are outside of such range. $R^1$ is preferably derived from coconut oil.

$R^2$, $R^3$ and $R^4$ are preferably methyl groups and $R^5$ is preferably a propylene radical. Accordingly, preferred betaines for use herein ar cocodimethylammonium acetate (cocobetaine) and cocoamidopropyl dimethylammonium acetate (cocoamido betaine).

An anionic detergent may optionally be employed in minor amounts to supplement the nonionic and amphoteric detergent compounds in the present liquid compositions. Generally, the amount of anionic detergent will be below about 3%, by weight, of the total composition because of the limited solubility of such detergents in the built liquid detergent composition. Alkyl benzene sulfonate salts wherein the alkyl group contains 10 to 18 carbon atoms are particularly limited in solubility in the present compositions, and hence it is preferred that the present compositions be substantially free of such compounds to avoid the possibility of product separation.

The preferred anionic detergents for use herein are sulfated ethoxylated higher fatty alcohols of the formula $RO(C_2H_4O)_mSO_3M$, wherein R is a fatty alkyl of from 10 to 18 or 20 carbon atoms, m is from 2 to 6 or 8 (preferably having a value from about 1/5 to ½ the number of carbon atoms in R) and M is a solubilizing salt-forming cation, such as an alkali metal, ammonium, lower alkyl-amino or lower alkanolamino. A preferred polyethoxylated alcohol sulfate detergent is available from Shell Chemical company and is marketed as Neodol 25-3S.

Water is the principal solvent in the concentrated liquid detergent compositions. The concentration of water may vary from about 35 to 65%, with a concentration in the range of 45 to 60%, by weight, being generally preferred. A co-solvent such as an alkylene glycol, e.g. ethylene glycol or propylene glycol, may optionally be employed in minor amounts for purposes of enhancing the solubility of the surfactant and builder in solution. The concentration of alkylene glycol in the detergent composition should, if present, be below about 10%, by weight, of the total composition, preferably below about 5%, and most preferably, the composition is substantially free of such alkylene glycol.

One or more alkali metal salts of nonyl succinic anhydride or nonyl maleic anhydride are included in the detergent composition because of their solubilizing properties with respect to nonionic surfactants and builder salts. Such solubilizer is used in an amount of from 5 to 8%, by weight, of the total composition, a concentration of at least 7% being preferred when the builder salt concentration is about 17% or higher.

Nonyl succinic anhydride is represented by the formula

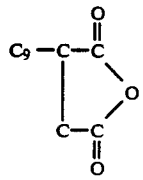

wherein $C_9$ represents a nine carbon member aliphatic chain, preferably alkyl. Nonyl maleic anhydride is similarly defined, the structures of succinic and maleic anhydride differing only by virtue of the unsaturated nature of maleic acid.

The non-phosphate detergent builder salts are employed in the present compositions in amounts generally of from about 15 to 18%, by weight. Specific examples of non-phosphate water-soluble inorganic builders include water-soluble inorganic carbonate, bicarbonate and silicate salts. The alkali (for example, sodium and potassium) carbonates, bioarbonates and silicates are particularly useful herein.

Water-soluble organic builders are also useful and include the alkali metal, ammonium and substituted ammonium polyacetates, carboxylates, polycarboxylates and polyhydroxysulfonates. Specific examples of polyacetate and polyoarboxylate builders include sodium, potassium, lithium, ammonium and substituted ammonium salts of ethylene diaminetetracetic acid, nitrilotriacetic acid, benzene polycarboxylic (i.e penta- and tetra-) acids, carboxymethoxysuccinic acid and citric acid. As used herein, the term "builder" does not include surfactants and soaps such as the water-soluble salts of higher fatty acids containing from about 8 to 20 carbon atoms.

The optical fluorescent brighteners or whiteners employed in the liquid detergent compositions are important constituents of modern detergent compositions which give washed laundry and materials a bright appearance so that the laundry is not only clean but also appears clean. Although it is possible to utilize a single brightener for a specific intended purpose in the present liquid detergent compositions, it is generally desirable to employ mixtures of brighteners which will have good brightening effects on cotton, nylons, polyesters and blends of such materials and which are also bleach stable. A good description of such types of optical brighteners is given in the article "The Requirements of present Day Detergent Fluorescent Whitening Agents" by A. E. Siegrist, J. Am. oil Chemists Soc., January 1978 (vol. 55). That article and U.S. Pat. No. 3,812,041, issued May 21, 1974, both of which are hereby incorporated by reference contain detailed descriptions of a wide variety of suitable optical brighteners.

Among the brighteners that are useful in the present liquid detergent compositions are: Calcofluor 5 BM (American Cyanamid); Tinopal LpW (Ciba); SOF A-2001 (Ciba); CDW (Hilton-Davis); Phorwite RKH, Phorwite BBH and Phorwite BHC (Verona); CSL, powder, acid (American Cyanamid); FB 766 (Verona); Blancophor PD (GAF); UNPA (Geigy); Tinopal RBS 200 (Geigy).

Adjuvants may be present in the liquid detergent compositions to provide additional properties, either functional or aesthetic. Included among the useful adjuvants are soil suspending or antiredeposition agents, such as polyvinyl alcohol, sodium carboxymethyl cellulose, hydroxypropylmethyl cellulose; thickeners, e.g., gums, alginates, agar; form improvers, e.g., lauric myristic diethanolamide; foam destroyers, e.g., silicones; bactericides, e.g., tribromosalioylanilide, hexachlorophene; dyes; pigments (water dispersible); preservatives; ultraviolet absorbers; fabric softeners; enzymes; opacifying agents, e.g., polystyrene suspensions; and perfumes. Of course, such materials will be selected based on the properties desired in the finished product, their compatibility with the other constituents, and their solubility in the liquid composition.

The present liquid compositions are efficient and easy to use. Compared to heavy duty laundry detergent powders, much smaller volumes of the present liquids are employed to obtain comparable cleaning of soiled laundry. For example, using a typical preferred formulation of this invention, only about 71 grams or ¼ cup of liquid is needed for a full tub of wash in a top-loading automatic washing machine in which the water volume is about 17 gallons (about 64 liters); and even less is needed for front-loading machines. Thus, the concentration of the liquid detergent composition in the wash water is on the order of about 0.1%. Usually, the proportion of the liquid composition in the was solution will range from about 0.05 to 0.3%, preferably from 0.10 to 0.20%. The proportions of the various constituents of the liquid composition may vary accordingly. Equivalent results can be obtained by using greater proportions of a more dilute formulation but the greater quantity needed will require additional packaging and will generally be less convenient for consumer use.

EXAMPLE 1

A concentrated built liquid detergent composition in accordance with the invention was formulated as set forth below. The percentages shown refer to the 100% active component.

| COMPONENT | WEIGHT PERCENT |
|---|---|
| Sodium Citrate | 17.2 |
| Ethoxylated $C_{12}$–$C_{13}$ alcohol (6.5 moles EO/mole alcohol) | 17.6 |
| Cocoamido betaine(1) | 3.1 |
| Nonyl succinic anhydride(2) (Potassium salt) | 7.0 |
| Brightener and dye | 0.2 |
| Water | Balance |

(1)Provided as "Varion CADG", an aqueous solution of cocoamido betaine sold by Sherex Chemical Company.
(2)The anhydride is provided as "Hoe 2817" sold by American Hoechst Company, which is then reacted with potassium hydroxide to form the potassium salt.

The above-described liquid composition was a clear blue-colored single-phase homogeneous liquid detergent having a viscosity of about 80 cp. at 75° F., and which poured satisfactorily from a plastic detergent bottle with a discharge opening of about 2.5 cm. The liquid detergent was employed to wash a mixed load of soiled laundry which included cotton swatches and polyester/cotton swatches soiled with particulate soil and with sebum soil. The wash temperature was 120° F. and the concentrations of the liquid detergent in the was bath was about 0.1%, by weight. After washing, the laundered items were rinsed in top water and then dried. The degree of stain removal was measured by taking a reflectance reading for each stained test swatch prior to and after the washing using a Gardner XL-20 colorimeter.

The laundering operation described above was repeated with a control detergent, a commercial aqueous built liquid detergent composition containing 19% dodeoylbenzene sulfonate, 10% sodium citrate, 7% ethoxylated alcohol surfactant, and 5% sodium toluene sulfonate hydrotrope used at a "½ cup" concentration of about 0.2%, by weight, in the bath. The detergency of both compositions was compared based on the measured stain removal achieved during laundering. The detergency of the liquid detergent of the invention at a "¼ cup" concentration was shown to be either equivalent to or superior to that achieved with the control liquid detergent at a "½ cup" concentration with respect to laundered soiled and stained fabrics.

EXAMPLE 2

The effect of incorporating a betaine detergent not in accordance with the invention into a built liquid detergent composition containing nonionic surfactant and a high concentration of builder was demonstrated by preparing two liquid compositions such a described in Example 1, except that the cocoamido betaine in the composition of Example 1 was replaced in one composition by stearyl betaine and in the second composition by palmytyl betaine. Both of the resulting compositions were unstable and formed separate phases in contrast to the stable clear solution which characterized the composition of Example 1.

EXAMPLE 3

Detergency tests were conducted with compositions A, B and c formulated as shown below. The numbers in the table represent the percent by weight, of each component in the liquid composition.

| COMPONENT | A | B | C |
|---|---|---|---|
| Sodium citrate | 17.2 | 17.2 | 17.2 |
| Ethoxylated $C_{12}$–$C_{13}$ alcohol (6.5 moles EO/mole alcohol) | 17.6 | 22.0 | 7.0 |
| Cocoamido betaine | 3.1 | — | 9.0 |
| Nonyl succinic anhydride (potassium salt) | 7.0 | 14.0 | — |
| Water | Balance | Balance | Balance |

All three compositions were clear, single-phase solutions. Composition A is a composition of the invention previously described in Example 1. Composition B represents the best performing formulation from the standpoint of detergency measured at a concentration of 0.1% in the bath from among compositions containing the same components of Composition A except for the omission of a betaine detergent, and which formed a clear single-phase solution. Similarly, composition c represents the best performing formulation from the standpoint of detergency measured at a concentration of 0.1% in the bath from among compositions containing the same components of composition A, but which contained no solubilizer, and which formed a clear single-phase solution. Compositions B and C are not in accordance with the invention.

The detergency of composition A, B and C was determined in a Tergotometer vessel manufactured by U.S. Testing Company on the following test fabrics under the stated conditions:

TEST FABRICS

TFN—Test fabric soil on Nylon
PCC—Piscataway clay on cotton
SC—Sebum particulate on cotton
SDC—Sebum particulate on Dacron/cotton
EMPA—EMPA 101 on heavy cotton

WASH CONDITIONS

| | |
|---|---|
| Liquid detergent concentration | 0.10% |
| Water temperature | 120° F. |
| Water hardness | About 150 ppm as calcium carbonate |

At the end of the wash, the test swatches were rinsed in tap water and then dried. A reflectance reading was taken for each test swatch prior to and after the washing using a Gardner XL-20 colorimeter. The values for the change in reflectance (ΔRd) are shown below in Table 1 for each of the aforementioned test fabrics. A difference greater than 0.8 between two values of ΔRd is considered significant for all washed test fabrics except for measurements on EMPA where only ΔRd values above 1.3 are considered significant.

TABLE 1

| | ΔRd Values for Fabrics Washed with Compositions A, B and C | | | | |
|---|---|---|---|---|---|
| COMPOSITION | TFN | PCC | EMPA | SC | SDC |
| A | 37 | 24 | 18 | 10 | 44 |
| B | 35 | 24 | 17 | 8 | 42 |
| C | 29 | 21 | 15 | 4 | 34 |

Table 1 demonstrates the unexpected improved detergency attendant to the use of a composition in accordance with the invention relative to two single-phase liquid detergent compositions similar thereto but which were not formulated in accordance with the invention. Composition A is shown to be superior to Composition B with respect to the majority of test fabrics laundered; and superior to Composition C with respect to virtually every test fabric laundered.

What is claimed:

1. A concentrated aqueous single-phase homogeneous built liquid detergent composition comprising:
(a) from about 15 to 18%, by weight, of a water-soluble non-phosphate detergent builder salt;
(b) from about 15 to 23%, by weight, of a surface active nonionic detergent compound which is the condensation product of 5 to 9 moles of ethylene oxide with one mole of an aliphatic alcohol containing 12 to 15 carbon atoms;
(c) from about 1 to 6%, by weight, of at least one amphoteric detergent compound selected from the group consisting of cocobetaine and cocoamido betaine;

(d) from about 5 to 8%, by weight, of a solubilizer selected from the group consisting of alkali metal salts of (i) nonyl succinic anhydride and (ii) nonyl maleic anhydride; and (e) from about 45 to 60%, by weight, water, said liquid detergent composition being free of an amine oxide surfactant and providing effective detergency at a product concentration equivalent to about ¼ cup under U.S. washing conditions.

2. A detergent composition as in claim 1 wherein said nonionic detergent compound is the condensation product of 6 to 7 moles of ethylene oxide with one mole of an aliphatic alcohol containing 12 to 13 carbon atoms.

3. A detergent composition as in claim 1 wherein said builder salt is sodium citrate.

4. A detergent composition as in claim 1 which contains less than about 3%, by weight, of a surface active anionic detergent compound.

5. A detergent composition as in claim 1 which is substantially free of a $C_{10}$–$C_{18}$ benzene sulfonate anionic detergent.

6. A detergent composition as in claim 1 which contains less than about 10%, by weight, of an alkylene glycol.

7. A detergent composition as in claim 1 which is substantially free of an alkylene glycol.

8. A detergent composition as in claim 1 wherein the concentration of builder salt is about 17% and the range of nonionic detergent compound is from about 16 to 18%, by weight, of the composition.

9. A detergent composition as in claim 1 wherein the concentration of said solubilizer in the composition is about 7%, by weight.

10. A method of laundering comprising contacting the stained and/or soiled fabrics to be laundered with a concentrated aqueous single-phase homogeneous liquid detergent composition comprising:

(a) from about 15 to 18%, by weight, of a water-soluble non-phosphate detergent builder salt;

(b) from about 15 to 23%, by weight, of a surface active nonionic detergent compound which is the condensation product of 5 to 9 moles of ethylene oxide with one mole of an aliphatic alcohol containing 12 to 15 carbon atoms;

(c) from about 1 to 6%, by weight, of at least one amphoteric detergent compound selected from the group consisting of cocobetaine and cocoamidobetaine;

(d) from about 5 to 8%, by weight, of a solubilizer selected from the group consisting of alkali metal salts of (i) nonyl succinic anhydride and (ii) nonyl maleic anhydride; and (e) from about 45 to 60%, by weight, water, said liquid detergent composition being free of an amine oxide surfactant and providing effective detergency at a product concentration equivalent to about 1/4 cup under U.S. washing conditions.

11. A method according to claim 10 wherein said builder salt is sodium citrate.

12. A method according to claim 10 wherein said nonionic detergent compound is the condensation product of 6 to 7 moles of ethylene oxide with one mole of an aliphatic alcohol containing 12 to 13 carbon atoms.

13. A method according to claim 10 wherein said liquid detergent composition is substantially free of a $C_{10}$–$C_{18}$ alkyl benzene sulfonate anionic detergent.

14. A method according to claim 10 wherein said liquid detergent composition is substantially free of an alkylene glycol.

15. A method according to claim 10 wherein the concentration of builder salt is about 17% and the range of nonionic detergent compound is from about 16 to 18%, by weight, of the composition.

16. A method according to claim 10 wherein the concentration of said solubilizer in the liquid composition is about 7%, by weight.

17. A method of laundering comprising (i) adding an effective amount of a concentrated aqueous single-phase homogeneous liquid detergent composition to an aqueous liquid to form a wash solution, said homogeneous liquid detergent comprising:

(a) from about 15 to 18%, by weight, of a water-soluble non-phosphate detergent builder salt;

(b) from about 15 to 23%, by weight, of a surface active nonionic detergent compound which is the condensation product of 5 to 9 moles of ethylene oxide with one mole of an aliphatic alcohol containing 12 to 15 carbon atoms;

(c) from about 1 to 6%, by weight, of at least one amphoteric detergent composed selected from the group consisting of cocobetaine and cocoamido betaine;

(d) from about 5 to 8%, by weight, of a solubilizer selected from the group consisting of alkali metal salts of (i) nonyl succinic anhydride and (ii) nonyl maleic anhydride; and (e) from about 45 to 60%, by weight, water, said liquid detergent composition being free of an amine oxide surfactant and providing effective detergency at a product concentration equivalent to about ¼ cup under U.S. washing conditions.

18. A method according to claim 17 wherein said builder salt is sodium citrate.

19. A method according to claim 17 wherein said liquid detergent composition is substantially free of a $C_{10}$–$C_{18}$ alkyl benzene sulfonate anionic detergent.

20. A method according to claim 17 wherein said liquid detergent composition is substantially free of an alkylene glycol.

21. A method according to claim 17 wherein the concentration of detergent composition in the wash water is about 0.1% by weight.

* * * * *